US007994105B2

(12) United States Patent
Narayan

(10) Patent No.: US 7,994,105 B2
(45) Date of Patent: Aug. 9, 2011

(54) LUBRICANT HAVING NANOPARTICLES AND MICROPARTICLES TO ENHANCE FUEL EFFICIENCY, AND A LASER SYNTHESIS METHOD TO CREATE DISPERSED NANOPARTICLES

(76) Inventor: Jagdish Narayan, Raleigh, NC (US)

( * ) Notice: Subject to any disclaimer, the term of this patent is extended or adjusted under 35 U.S.C. 154(b) by 828 days.

(21) Appl. No.: 11/979,529

(22) Filed: Nov. 5, 2007

(65) Prior Publication Data

US 2009/0042751 A1 Feb. 12, 2009

Related U.S. Application Data

(60) Provisional application No. 60/955,348, filed on Aug. 11, 2007.

(51) Int. Cl.
*C10M 169/04* (2006.01)
*C10M 111/04* (2006.01)
*C01G 39/06* (2006.01)

(52) U.S. Cl. ..... 508/113; 508/155; 508/161; 508/165; 508/172; 977/773

(58) Field of Classification Search ..... 508/113, 508/155, 172, 165, 167, 161; 977/773
See application file for complete search history.

(56) References Cited

U.S. PATENT DOCUMENTS

| | | | |
|---|---|---|---|
| 4,376,755 | A | 3/1983 | Narayan et al. |
| 5,262,206 | A | 11/1993 | Rangaswamy et al. |
| 5,385,683 | A | 1/1995 | Ransom |
| 5,523,006 | A | 6/1996 | Strumban |
| 5,827,337 | A | 10/1998 | Keil |
| 6,152,453 | A | 11/2000 | Kashima et al. |

(Continued)

FOREIGN PATENT DOCUMENTS

| | | | |
|---|---|---|---|
| JP | 2003059868 | A | 2/2003 |

OTHER PUBLICATIONS

S. C. Tung and M. L. McMillan, "Automotive tribology overview of current advances and challenges for the future," Tribology International 37, pp. 517-536 (2004).

(Continued)

*Primary Examiner* — Glenn A Caldarola
*Assistant Examiner* — Vishal Vasisth
(74) *Attorney, Agent, or Firm* — Buchanan Ingersoll & Rooney PC

(57) ABSTRACT

A combination nano and microparticle treatment for engines enhances fuel efficiency and life duration and reduces exhaust emissions. The nanoparticles are chosen from a class of hard materials, preferably alumina, silica, ceria, titania, diamond, cubic boron nitride, and molybdenum oxide. The microparticles are chosen from a class of materials of layered structures, preferably graphite, hexagonal boron nitride, magnesium silicates (talc) and molybdenum disulphide. The nano-micro combination can be chosen from the same materials. This group of materials includes zinc oxide, copper oxide, molybdenum oxide, graphite, talc, and hexagonal boron nitride. The ratio of nano to micro in the proposed combination varies with the engine characteristics and driving conditions. A laser synthesis method can be used to disperse nanoparticles in engine oil or other compatible medium. The nano and microparticle combination when used in engine oil can effect surface morphology changes such as smoothening and polishing of engine wear surfaces, improvement in coefficient of friction, and fuel efficiency enhancement up to 35% in a variety of vehicles (cars and trucks) under actual road conditions, and reduction in exhaust emissions up to 90%.

15 Claims, 16 Drawing Sheets

U.S. PATENT DOCUMENTS

| | | | | |
|---|---|---|---|---|
| 6,231,980 | B1 * | 5/2001 | Cohen et al. | 428/402 |
| 6,268,316 | B1 | 7/2001 | Tanaka et al. | |
| 6,294,507 | B1 | 9/2001 | Dahl | |
| 6,329,327 | B1 | 12/2001 | Tanaka et al. | |
| 6,335,309 | B1 | 1/2002 | Takagi et al. | |
| 6,423,669 | B1 | 7/2002 | Alexandrov et al. | |
| 6,767,871 | B2 | 7/2004 | Devlin et al. | |
| 6,783,746 | B1 | 8/2004 | Zhang et al. | |
| 6,878,676 | B1 | 4/2005 | Migdal et al. | |
| 2001/0005009 | A1 | 6/2001 | Tsuchiya et al. | |
| 2001/0015180 | A1 | 8/2001 | Tinney | |
| 2002/0090155 | A1 | 7/2002 | Ushijima et al. | |
| 2003/0183178 | A1 | 10/2003 | Caprotti et al. | |
| 2004/0147409 | A1 * | 7/2004 | Tequi et al. | 508/156 |
| 2004/0206491 | A1 | 10/2004 | Davidson et al. | |
| 2005/0025694 | A1 | 2/2005 | Zhang et al. | |
| 2005/0119134 | A1 | 6/2005 | Tequi et al. | |
| 2005/0124504 | A1 | 6/2005 | Zhang et al. | |
| 2005/0130851 | A1 * | 6/2005 | Wang | 508/127 |
| 2005/0151114 | A1 | 7/2005 | Davidson et al. | |
| 2005/0188942 | A1 | 9/2005 | Hamada et al. | |
| 2006/0040832 | A1 | 2/2006 | Zhang et al. | |
| 2006/0094605 | A1 | 5/2006 | Bakunin et al. | |
| 2006/0117947 | A1 | 6/2006 | Tabata et al. | |
| 2006/0135374 | A1 | 6/2006 | Cooper et al. | |
| 2007/0004602 | A1 | 1/2007 | Waynick | |
| 2007/0158609 | A1 | 7/2007 | Hong et al. | |
| 2007/0161518 | A1 | 7/2007 | Walker et al. | |
| 2007/0191240 | A1 | 8/2007 | Suda | |
| 2008/0108218 | A1 * | 5/2008 | Kodas et al. | 438/610 |
| 2008/0312111 | A1 * | 12/2008 | Malshe et al. | 508/155 |

OTHER PUBLICATIONS

A. Erdemir, "Review of engineered tribological interfaces for improved boundary lubrication," Tribology International 38, pp. 249-256 (2005).

J. Narayan and J. Washburn, "Electron microscopic studies of micro-erosion in brittle solids," Wear 23, pp. 128-132 (1973).

J. Narayan, "The characterization of the damage introduced during micro-erosion of MgO single crystals," Wear 25, pp. 99-109 (1973).

J. Narayan, Y. Chen and R. M. Moon, "Nickel Colloids in MgO," Physical Review Letters, vol. 46, No. 22, pp. 1491-1494 (Jun. 1981).

J. Narayan, Y. Chen, R. M. Moon, R. W. Carpenter, "Characterization of metal precipitates in magnesium oxide", Philosophical Magazine A, vol. 49, No. 2, pp. 287-300 (1984).

J. Narayan, Y. Chen, "Physical properties of oxides containing metal precipitates", Philosophical Magazine A, vol. 49, No. 4, pp. 475-492 (1984).

E. Meyer, R. Overney, D. Brodbeck, L. Howald, R. Luthi, J. Frommer, and H.-J. Guntherodt, "Friction and wear of Langmuir-Blodgett films observed by friction force microscopy," Physical Review Letters, vol. 69, No. 12, pp. 1777-1780 (Sep. 1992).

J. Wang, K. C. Rose, and C. M. Lieber, "Load-independent friction: $MoO_3$ lubricants," J. Phys. Chem. B, vol. 103, No. 40, pp. 8405-8409 (1999).

J. S. Zabinski, J. Corneille, S. V. Prasad, N. T. McDevitt, and J. B. Bultman, "Lubricious zinc oxide films," J. Materials Science 32, pp. 5313-5319 (1997).

S. C. Singh, R. Gopal, "Zinc nanoparticles in solution by laser ablation technique", Bull. Mater. Sci., vol. 30, No. 3, pp. 291-293 (Jun. 2007).

S. V. Prasad, S. D. Walck and J. S. Zabinski, "Microstructural evolution in lubricious ZnO films grown by pulsed laser deposition," Thin Solid Films 360, pp. 107-117 (2000).

J.-H. Wu, B. S. Phillips, W. Jiang, J. H. Sanders, J. S. Zabinski, and A. P. Malshe, "Bio-inspired surface engineering and tribology of $MoS_2$ overcoated cBN-TiN composite coating," Wear 261, pp. 592-599 (2006).

Y. Y. Wu, W. C. Tsui, and T. C. Liu, "Experimental analysis of tribological properties of lubrication oils with nanoparticle additives," Wear 262, pp. 819-825 (2007).

B. Li, X. Wang, W. Liu, and Q. Xue, "Tribochemistry and antiwear mechanism of organic-inorganic nanoparticles as lubricant additives," Tribology Letters, vol. 22, No. 1, pp. 79-84 (2006).

International Search Report and Written Opinion dated Oct. 31, 2008 for PCT/US2008/009568.

* cited by examiner

LUBRICANT HAVING NANOPARTICLES AND MICROPARTICLES TO ENHANCE FUEL EFFICIENCY, AND A LASER SYNTHESIS METHOD TO CREATE DISPERSED NANOPARTICLES

CROSS-REFERENCE TO RELATED APPLICATION

This application claims priority to U.S. Patent Provisional Application No. 60/955,348, filed Aug. 11, 2007, which is incorporated herein by reference in its entirety.

SUMMARY

As disclosed herein, a combination of nano and microparticle treatment for engines enhances fuel efficiency and life duration and reduces exhaust emission. The nanoparticles are chosen from a class of hard materials, preferably alumina, silica, ceria, titania, diamond, cubic boron nitride, and molybdenum oxide. The microparticles are chosen from a class of materials of layered structures, preferably graphite, hexagonal boron nitride, magnesium silicates (talc) and molybdenum disulphide. The nano-micro combination can be chosen from the same materials. This group of materials includes zinc oxide, copper oxide, molybdenum oxide, graphite, talc, and hexagonal boron nitride. The ratio of nano to micro in the proposed combination varies with the engine characteristics and driving conditions. Further disclosed herein is a laser synthesis method for nanoparticles, where particles are already dispersed in the engine oil and in other compatible mediums. Using the nano and microparticle combinations in engine oil it is possible to effect surface morphology changes such as smoothening and polishing of engine wear surfaces to thereby lower coefficient of friction and improve fuel efficiency up to 35% in a variety of vehicles (cars and trucks) under actual road conditions, with reduction in exhaust emissions up to 90%.

A lubricant such as engine oil comprises hard nanoparticles which become embedded in lubricated surfaces and soft layered microparticles which fill voids in the lubricated surfaces.

A method of reducing friction of wear surfaces comprises lubricating the wear surfaces with lubricant containing hard nanoparticles and soft layered microparticles wherein the nanoparticles are effective to polish the wear surfaces with at least some of the nanoparticles becoming embedded in the wear surfaces and the layered microparticles being effective to buildup in voids (pits and grooves) in the wear surfaces.

BRIEF DESCRIPTION OF THE DRAWINGS

FIG. 12(*b*) shows the surface at medium magnification after further polishing and coverage by graphite nano and microparticles; and FIG. 12(*c*) shows the surface at high magnification after embedding of nanoparticles of graphite due to conversion of graphite microparticles into nanoparticles.

FIG. 13(*b*) shows the surface at medium magnification after further polishing and coverage by alumina nano and graphite microparticles; and FIG. 13(*c*) shows the surface after embedding of nanoparticles of alumina and conversion of graphite microparticles into nanoparticles.

FIG. 14(*a*) showing embedding and filling in of surface roughness; FIG. 14(*b*) showing mostly embedding of alumina and graphite nanoparticles into the aluminum alloy metallic surface; and FIG. 14(*c*) is an X-ray chemical analysis showing no other surface contamination.

FIG. 15(*b*) shows the surface at high magnification after further polishing and coverage by alumina nano and graphite microparticles; and FIG. 15(*c*) shows the surface at high magnification after embedding of nanoparticles of alumina and graphite showing conversion of graphite microparticles into nanoparticles.

DETAILED DESCRIPTION

Figure 1:
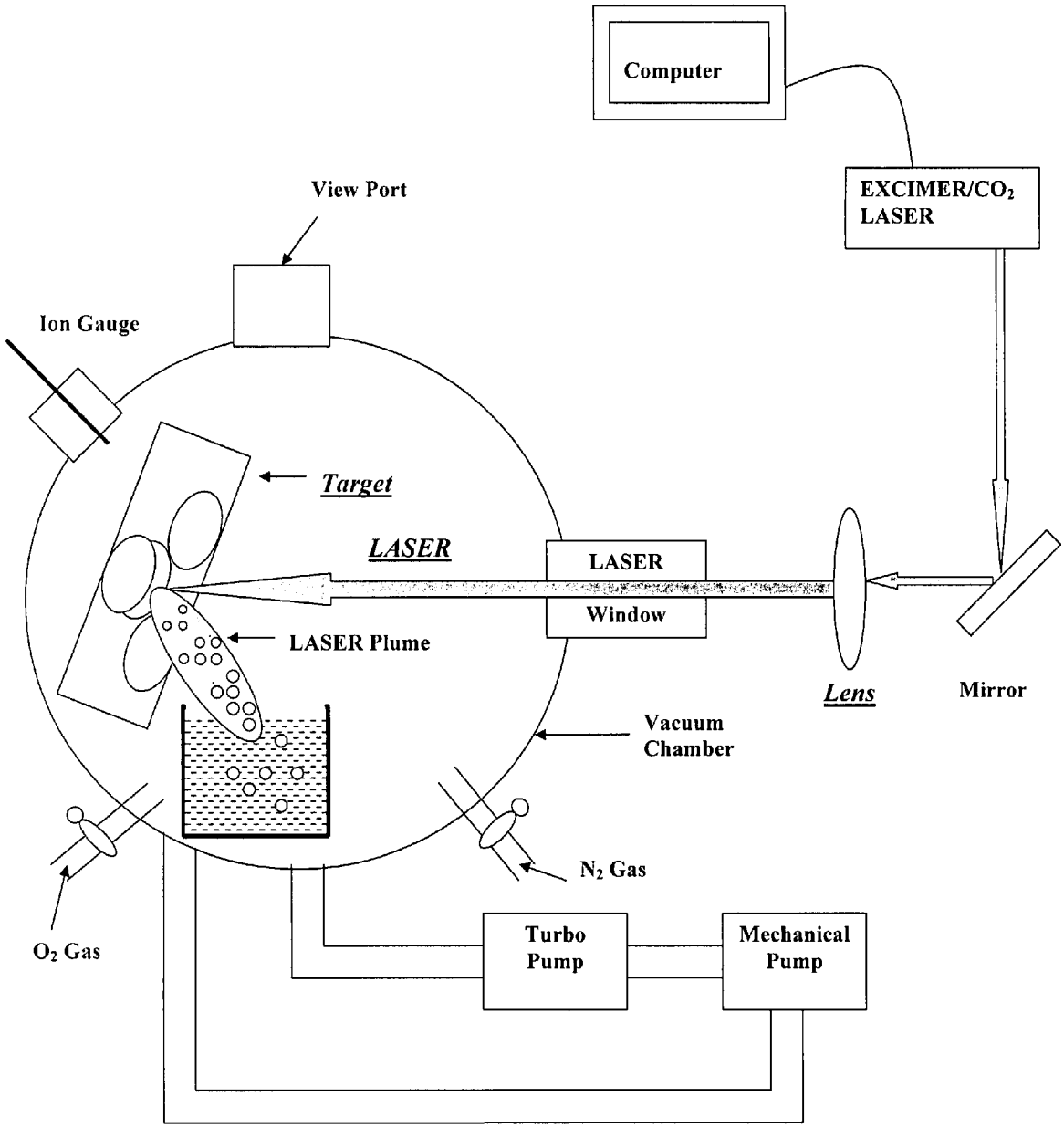
FIG. 1. is a schematic of a pulsed laser synthesis method for producing nanoparticles which are dispersed directly into oil wherein one or more gases can be introduced through a nozzle to control the chemical composition and/or coating of nanoparticles.

Described herein is a novel concept into oil additives, where a combination of nanoparticles and microparticles are added into oil to smoothen and polish metallic surfaces and embed nanoparticles in the near surface regions, thereby reducing friction and wear. The additives may be in the form of nanoparticles (≦100 nm) and microparticles (≧100 nm), nanorods, nanotubes, nanobelts, and buckyballs. The nanoparticles in the size range (5-100 nm) reduce wear and friction by polishing, grinding and embedding into the metallic substrates. Microparticles (100 nm-20,000 nm), on the other hand, reduce friction by layering at the wear interfaces. The nanoparticles and microparticles can also improve physical properties such as electrical and thermal conductivity and breakdown characteristics of the oil. The nanoparticles are chosen from a class of hard materials, preferably alumina, silica, ceria, titania, diamond, cubic boron nitride, and molybdenum oxide. The microparticles are chosen from a class of materials of layered structures, preferably graphite, hexagonal boron nitride, magnesium silicates (talc) and molybdenum disulphide. The nano-micro combination can be chosen from the same materials. This group of materials includes zinc oxide, copper oxide, molybdenum oxide, graphite, talc, and hexagonal boron nitride. The relative fraction of nanoparticles to microparticles may vary from 10 to 80%, depending upon the characteristics of the wear surfaces. For newer engines, a higher fraction of nanoparticles is preferred while for older engines (e.g., 50,000 miles and higher), a higher fraction of microparticles is preferred. For engine applications, these additives are expected to eliminate environmental toxic effects associated with current oil additive formulations based upon zinc dialkyl dithiophosphate (ZDDP).

Also described herein is the formation of nanoparticles of various compositions by a novel laser synthesis method. By using this method, nanoparticles of desired chemical composition and narrow-size distribution are formed and dispersed directly into a desired medium such as an oil lubricant, thus solving a critical agglomeration problem associated with nanoparticles. Microparticles are added into the engine oil, in which nanoparticles are already dispersed, in a certain concentration and a size range to improve fuel efficiency and life duration. The size of microparticles is below the pore size of the oil filter to avoid clogging of the filters. This treatment results in surface smoothening and polishing, and embedding of particles to reduce friction and wear of the metallic engine surfaces. These additives lead to improvement in fuel efficiency as much as 35% in gasoline engines and further improvements in fuel efficiency are expected with optimization. These additives are also expected to reduce wear and improve life of other engines. These materials can be also dispersed in a base such as mineral oil, synthetic oil such as polyolefin, and polymers in a concentration of 1-10% with an overall final concentration of about 0.02 to 0.2% in the engine oil. To improve dispersion further certain surfactants may be added. Preliminary results have shown a considerable reduction of coefficient friction from a typical value of 0.22 to 0.01. Road tests combining city and highway driving showed an improvement form 22 mpg to 30 mpg after addition of an oil additive containing nanosilica, nanoalumina and micrographite in a Toyota passenger car which amounts to over 35±3% improvement in the fuel efficiency. Similar results on high fuel efficiency have been obtained in Volkswagen cars and Ford (F-150) trucks. Reduction in exhaust emissions of carbon dioxide and carbon monoxide of at least 10%, at least 20%, at least 30%, at least 40%, at least 50% and up to 90% can be achieved after the nano and microparticle treatments of this invention.

The nanoparticles include alumina, silica, ceria, titania, diamond, cubic boron nitride, and molybdenum oxide, which can be embedded into cast iron, aluminum and its alloys to increase hardness and thereby reduce friction and wear. The nanoparticles can be dispersed into the engine oil during pulsed laser ablation synthesis. Nanoparticles can also be synthesized by other physical and chemical vapor deposition methods and dispersed into the engine oil with a concentration, in weight % (wt. %) of 1.0 to 10.0%. Microparticles in the size range below the pore size of the oil filter are dispersed into the engine oil with a concentration of 1.0 to 10.0% wt. The microparticles are chosen from a class of materials of layered structures, preferably graphite, hexagonal boron nitride, magnesium silicates (talc) and molybdenum disulphide. As an example, about 50 mL of nanoparticle formulation and 50 mL of microparticle formulation can be added in one treatment of 5 quarts of engine oil, typically low viscosity 0W20, 5W20, 5W30 engine oil.

There are three distinct regimes depending upon relative sizes of oil film thickness and nanoparticles which affect friction wear and lubrication. If the oil film thickness $t_o$ is greater than the particle size $d_n$, the nanoparticles will not be as effective in changing the friction characteristics. This is known as the hydrodynamic regime. If to $t_o \approx d_n$, the friction will be reduced by riding on the nanoparticles and reducing the contact area. If the contact area stays fixed, then this situation can lead to load independent friction. This is known as the mixed regime. When $t_o < d_n$, oil thickness is less than the size of the nanoparticles. In this case, the nanoparticles play a critical role in altering the friction and wear. In this case, nanoparticles are embedded into the surface, thereby hardening the surface and reducing the coefficient of friction. Also, sliding on the surfaces of nanoparticles will be very effective in altering the interfacial friction. This is known as the boundary layer regime.

The relative contribution of nanoparticles and microparticles under boundary lubrication, mixed, and hydrodynamic or rolling conditions is addressed as follows. For nanoparticles, under boundary lubrication conditions, there will be polishing and smoothening out of the surface, in addition to the near surface plastic damage which will harden the surface. All of these effects will reduce friction and wear. Under mixed lubrication conditions, there will be less polishing and smoothening out of the interior surfaces of an engine. Under hydrodynamic lubrication conditions, nanoparticles will not be as effective because boundary layer is much thicker than their size. For microparticles, under boundary lubrication conditions, there will be polishing and smoothening out of the surface, which will reduce friction and wear. Under mixed lubrication conditions, there will still be polishing and smoothening out of the interior surfaces. Under hydrodynamic lubrication conditions, microparticles may be effective depending upon the relative thickness of the boundary layer and the size of the microparticles.

With respect to engine oil treatment, under boundary lubrication, there is fine polishing and some embedding of nanoparticles which can lead to work hardening, and under mixed and hydrodynamic lubrication, there is very limited polishing and work hardening. Regarding microparticles, under boundary lubrication, there is very limited work hardening, and friction reduction is obtained by riding the layered platelets of microparticles in mixed as well as hydrodynamic conditions.

Under high-viscosity or low-temperature operating conditions, if the boundary layer is thicker than the particle size, the treatment will not be effective. Thus, nanoparticles dispersed in low-viscosity (preferably 0W20, 5W20, 5W30) oils are found to be more effective, and effectiveness will increase with increasing temperature. As temperature increases, microparticles will take part first in smoothening the surface by filling the voids (pits and grooves) such as undulations and by providing smooth layered structures. As the boundary layer thickness decreases and boundary lubrication sets in, nanoparticles can reduce friction and wear by embedding and work hardening the wear surface regions.

The nanomaterials used in the oil additive are preferably synthesized by a pulsed laser processing method, which results in dispersed nanoparticles in any suitable medium such as mineral oil, engine oil, synthetic oil such as polyalphaolefin (PAO), and other hydrocarbons.

FIG. 1 shows a schematic of the laser processing chamber, where a high-power pulsed laser is used to ablate either a metallic or a compound target in a controlled ambient. Various types of lasers can be used for this purpose such as: (1) Pulsed EXCIMER laser wavelength from 193 nm to 500 nm with pulse duration in the nanosecond regime and energy density of 2-10 $cm^{-2}$; and (2) Pulsed $CO_2$ laser where duration is varied from hundreds of nanoseconds (ns) to microseconds (μs). Thus, change in pulse duration from ns to μs increases the throughput of the nanoparticles/nanopowders considerably. For microsecond pulsed lasers, mean power is about 600-800W and peak power is about 10 kW. The chemical composition of nanoparticles can be varied by controlling the laser plume and injecting appropriate reactant gases through the nozzle. This method also allows the coating of nanoparticles and the modification of surface properties to enhance dispersion in mineral oil, synthetic oil such as polyalphaolefin (PAO), and hydrocarbons. The method described herein provides a considerable improvement with respect to throughput and dispersion of nanoparticles directly into an oil medium due to the force of the nanoparticles created via laser ablation of target material.

Figure 11:
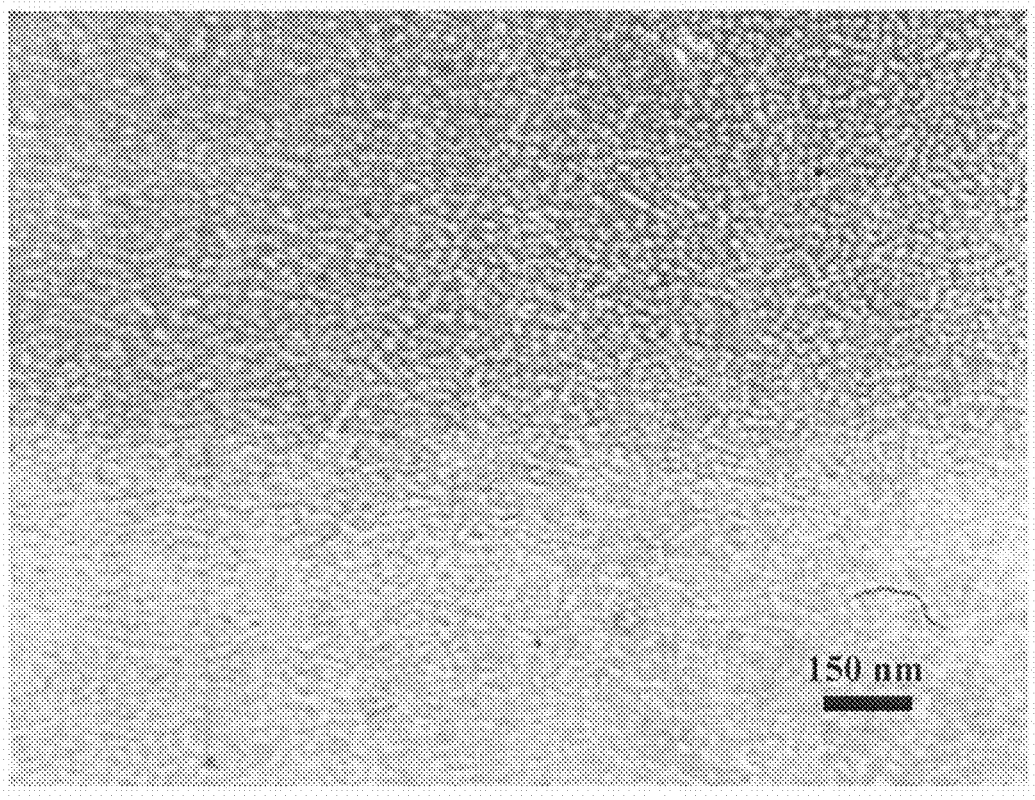
FIG. 11 is a photomicrograph of $CeO_2$ nanoparticles dispersed in 5W30 motor oil.

Pulsed laser can produce nanoparticles having a narrow size distribution. A continuous $CO_2$ laser produces ~40-60 nm particles, whereas a pulsed $CO_2$ laser (pulse duration 100 μs, 400-500 Hz) can produce average an particle size of 15 nm, as shown in FIG. 11 for ceria nanoparticles.

Figures 2A, 2B, 2C:
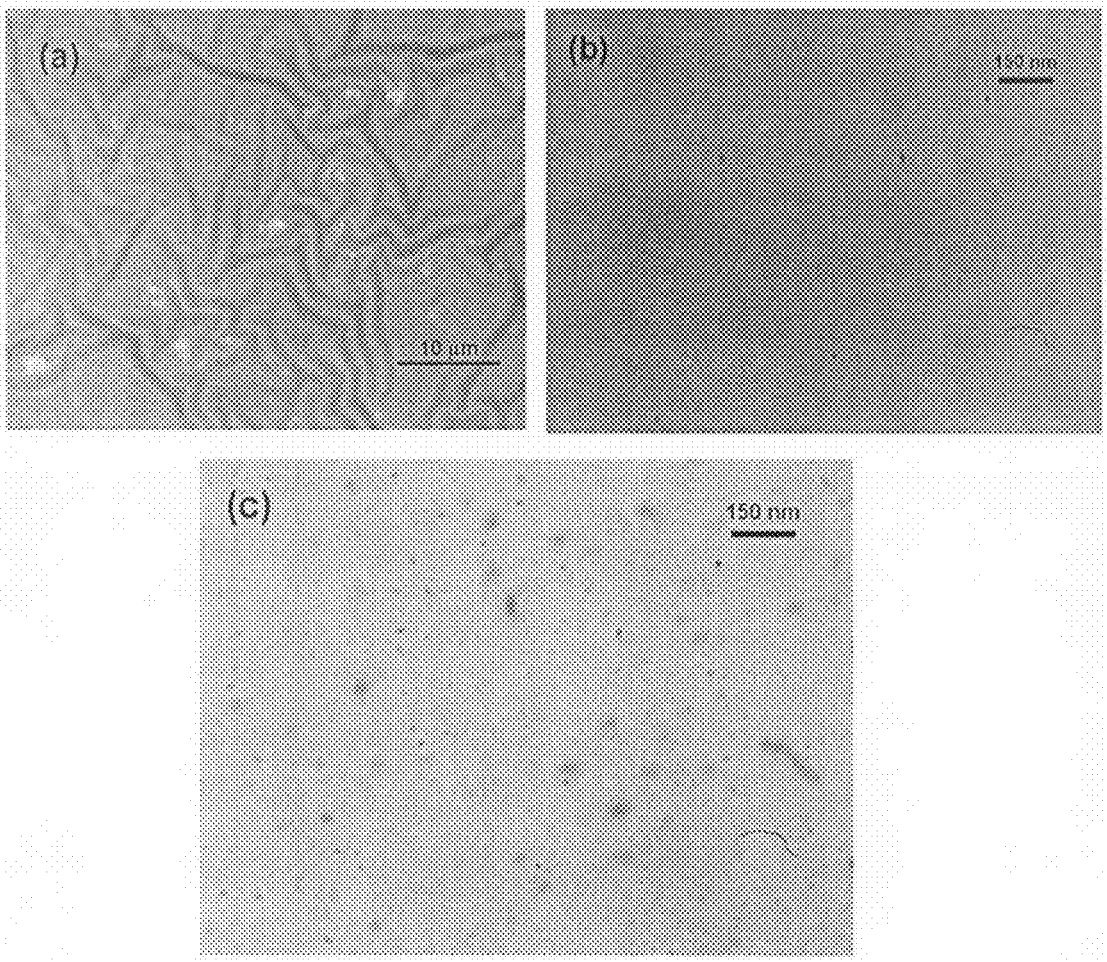
FIGS. 2(*a*), (*b*), and 2(*c*) are photomicrographs of ZnO nanoparticles produced by ablation of a zinc target in oxygen ambient (average size 30 nm) and dispersed in mineral oil.
Figure 3A:
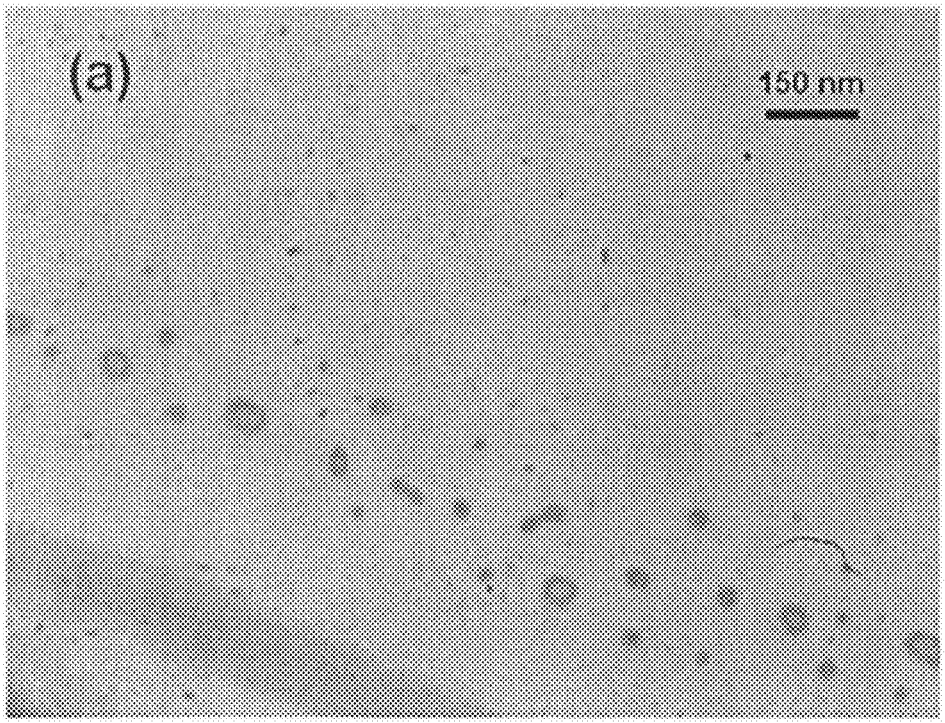
FIGS. 3 (*a*) and (*b*) are photomicrographs of CuO nanoparticles produced by ablation of a copper target in oxygen ambient, and dispersed in the mineral oil.
Figure 3B:
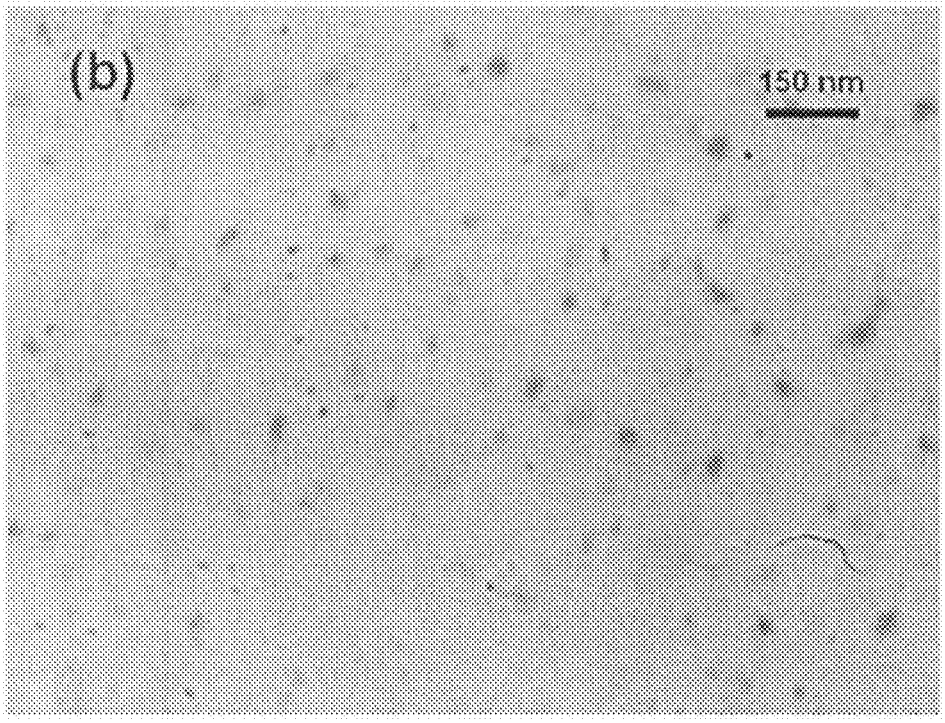
Figure 4:
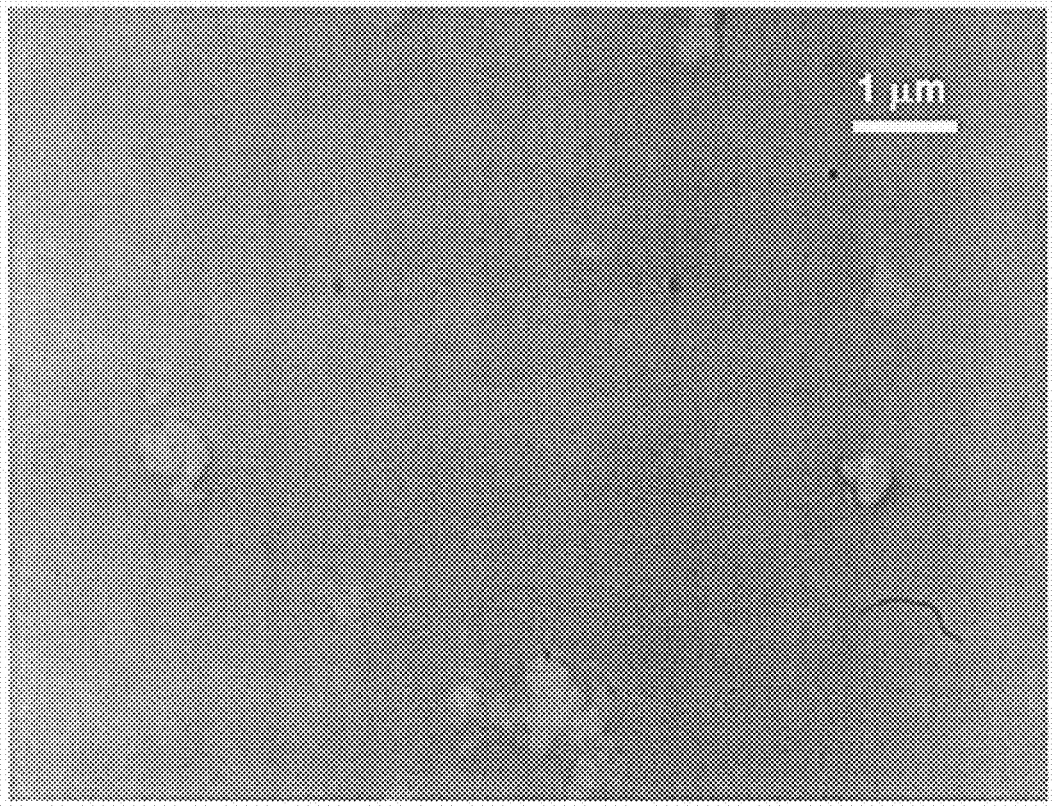
FIG. 4 is a photomicrograph of h-BN nanoparticles and microparticles dispersed in 5W30 motor oil.
Figure 5:
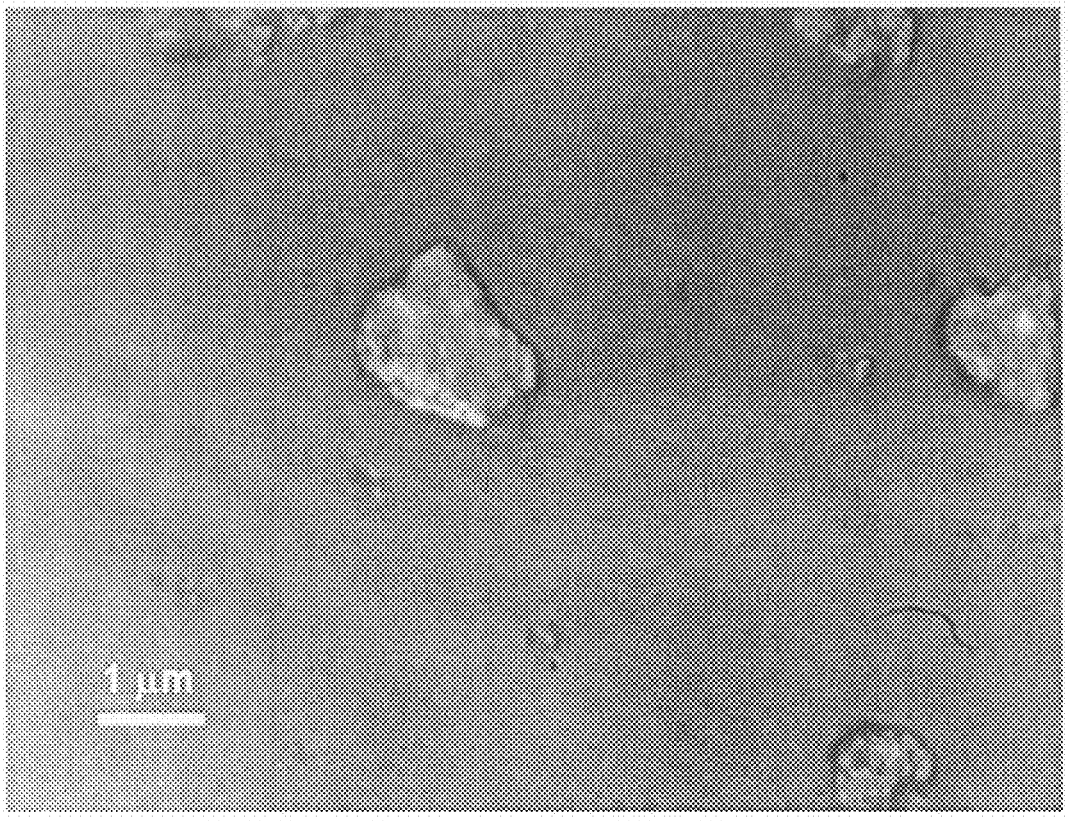
FIG. 5 is a photomicrograph of graphite nanoparticles and microparticles dispersed in 5W30 motor oil.
Figure 6:
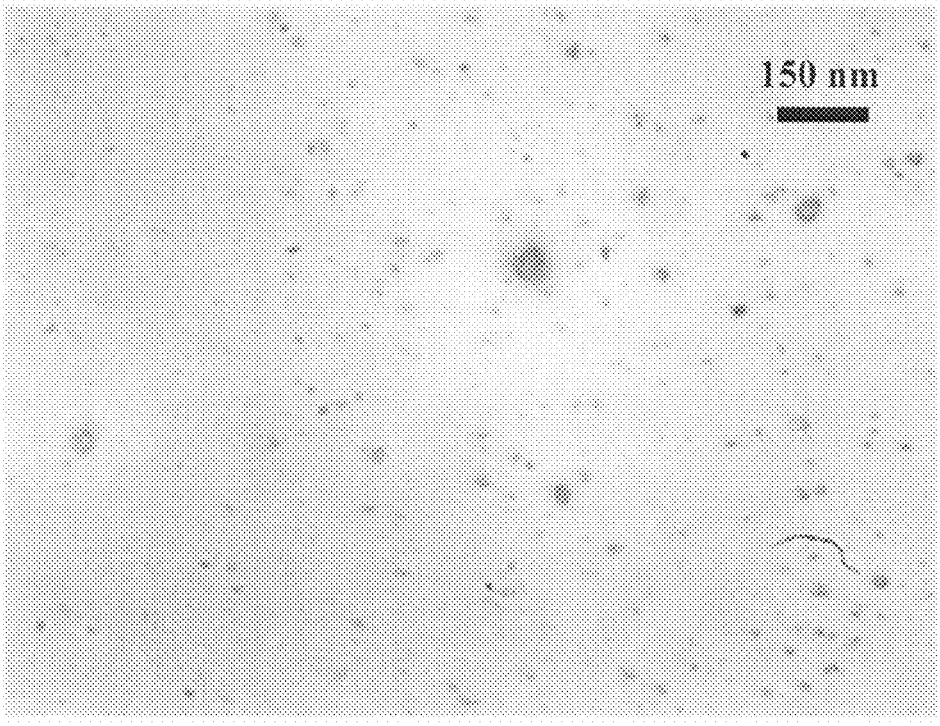
FIG. 6 is a photomicrograph of alumina nanoparticles dispersed in 5W30 motor oil.
Figure 7:
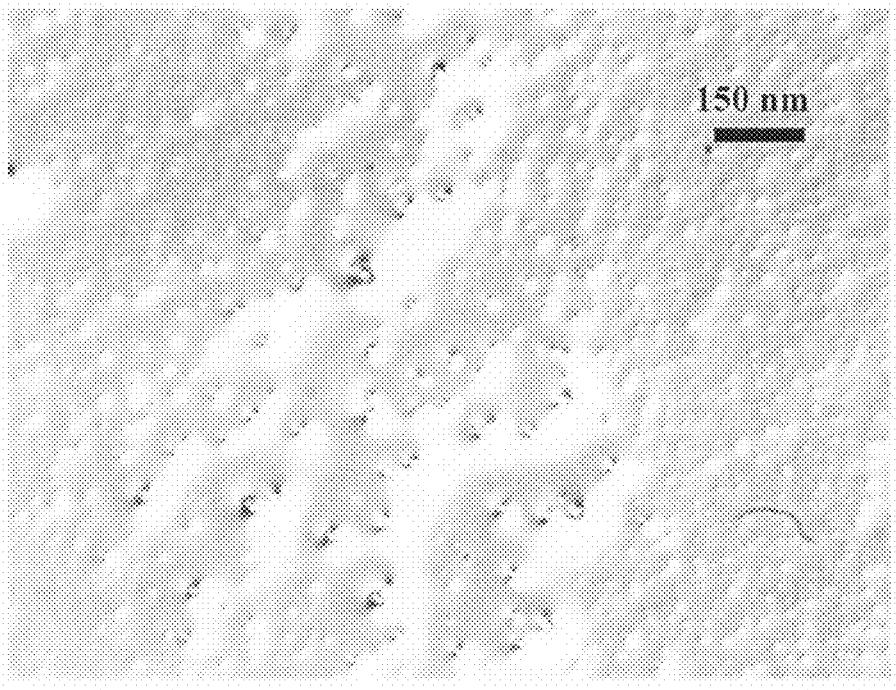
FIG. 7 is a photomicrograph of silica nanoparticles dispersed in 5W30 motor oil.
Figure 8:
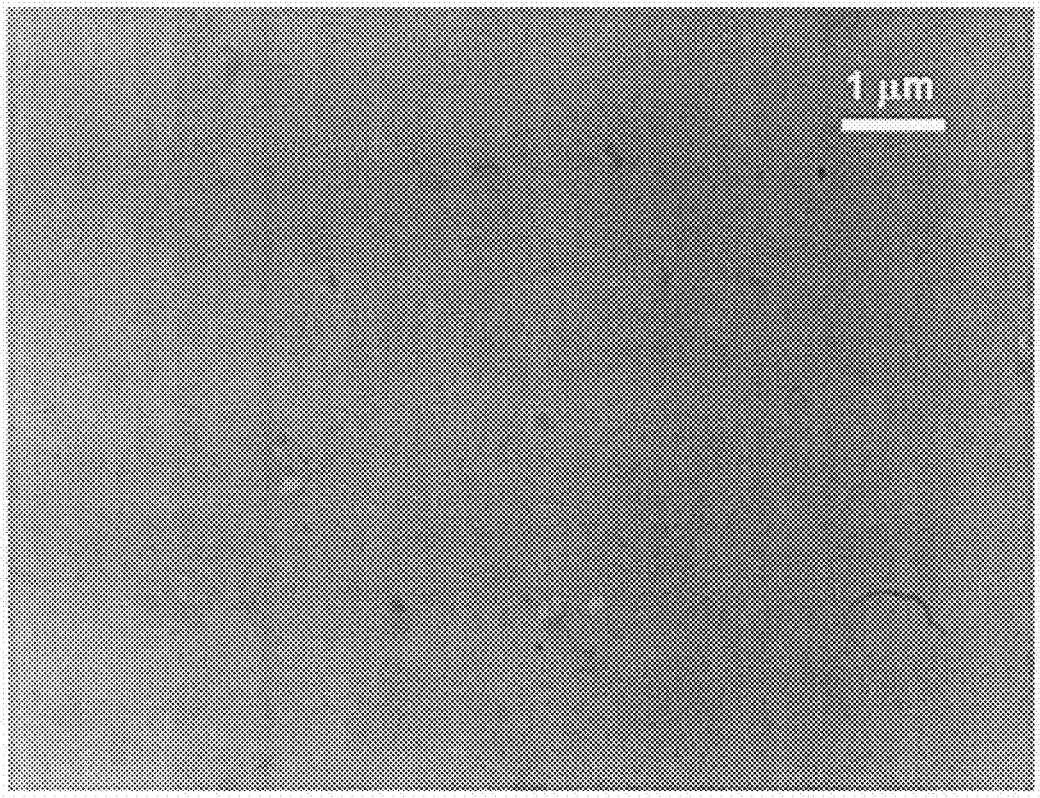
FIG. 8 is a photomicrograph of $MoS_2$ (molybdenum disulphide) microparticles dispersed in 5W30 motor oil.
Figure 9:
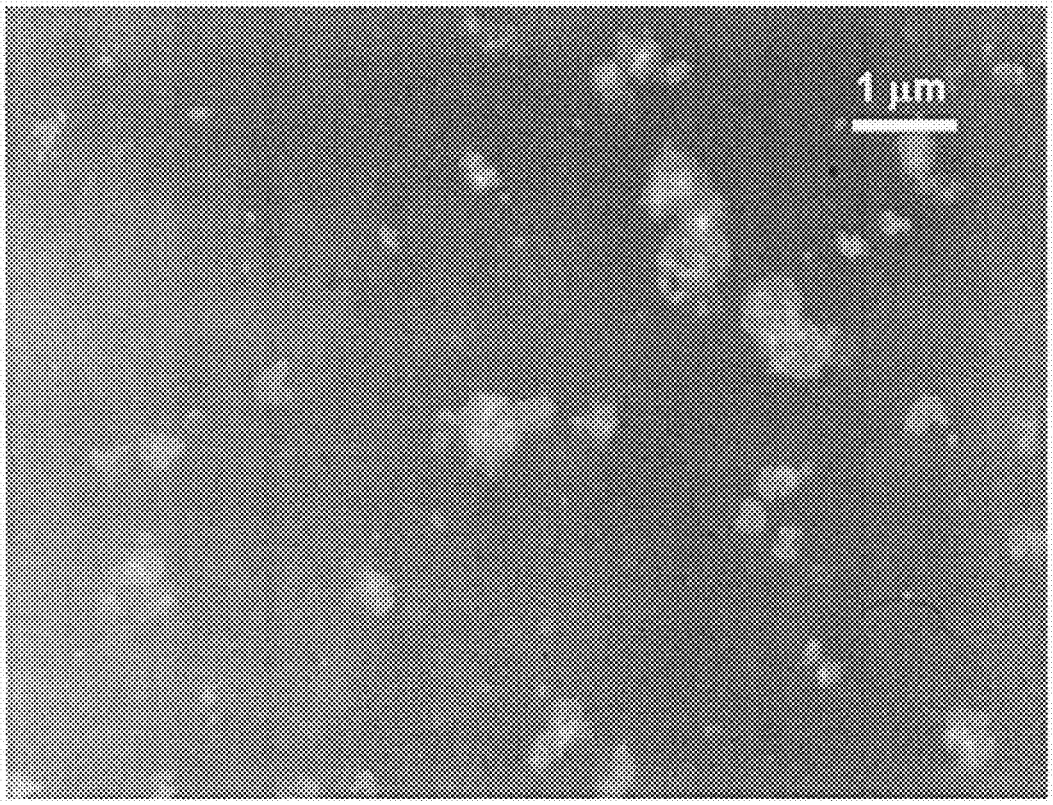
FIG. 9 is a photomicrograph of talc nano microparticles dispersed in 5W30 motor oil.
Figure 10:
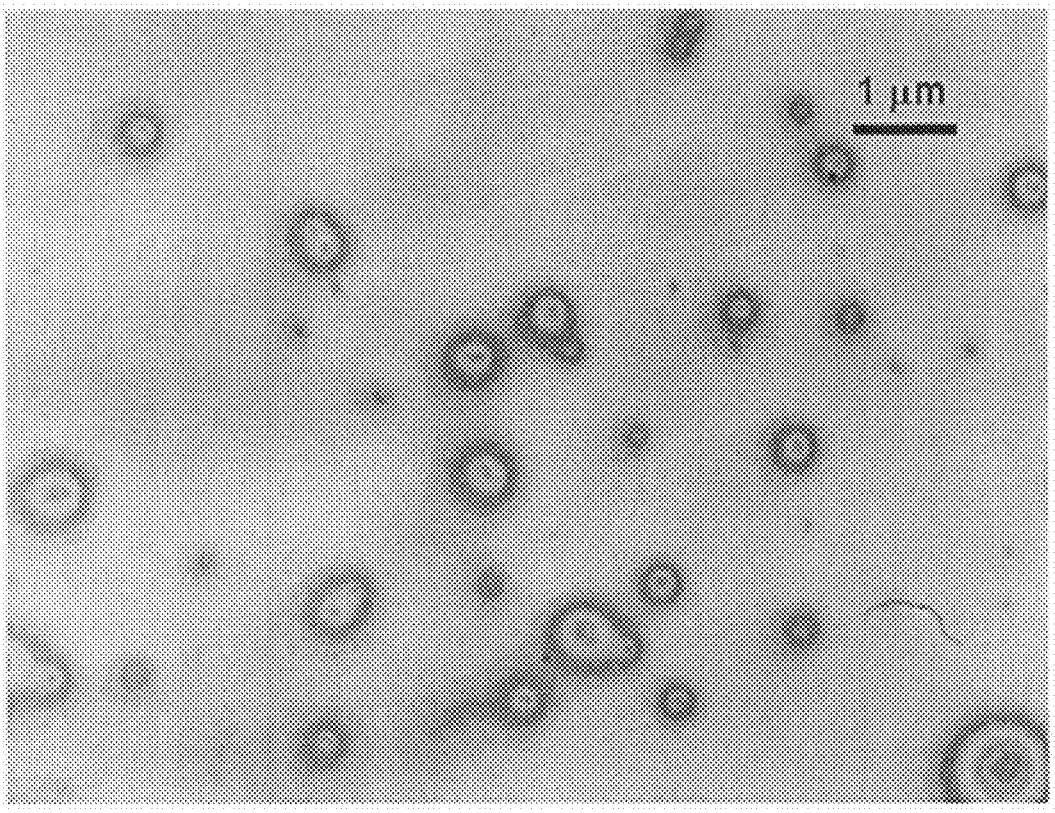
FIG. 10 is a photomicrograph of $TiO_2$ nanoparticles dispersed in 5W30 motor oil.

FIG. 2(*a*), (*b*) and (*c*) show ZnO nanoparticles produced by pulsed laser ablation using zinc target in oxygen ambient at atmospheric pressure. The nanparticle average size is 30 nm and the ZnO nanoparticles are dispersed in the automobile engine oil 5W30 (Volvoline). FIGS. 3 (*a*) and (*b*) show CuO nanoparticles produced by ablation of copper target in the oxygen ambient. FIG. 4 shows nano and microparticles of h-BN dispersed in the engine oil 5W30 (Volvoline). FIG. 5 shows nano and microparticles of graphite dispersed in the engine oil 5W30 (Volvoline). FIG. 6 shows nanoparticles of alumina (average size 30-40 nm) dispersed in the engine oil 5W30 (Volvoline). FIG. 7 shows nanoparticles of silica (average size 15 nm) dispersed in the engine oil 5W30 (Volvoline). FIG. 8 shows nano and microparticles of molybdenum disulphide dispersed in the engine oil 5W30 (Volvoline). FIG. 9 shows nanoparticles of titania ($TiO_2$) dispersed in the engine oil 5W30 (Volvoline). FIG. 10 shows nano and microparticles of talc dispersed in the engine oil 5W30 (Volvoline). The dispersion of ceria ($CeO_2$) nanoparticles is clearly shown in FIG. 11 with average size of 15 nm.

To examine the role of nanoparticles and microparticles on the interior surfaces of the engines, the rubbing action between piston (steel) and cylinder walls (aluminum alloy and cast iron) was simulated. The nanoparticle and microparticle treated engine oil was placed between steel/cast iron and steel/aluminum surfaces, and relative piston/cylinder wall motion simulated. The smoothening and polishing effects by nano and microparticles, embedding of nanoparticles for surface hardening, layering of microparticles, and reduction of friction and wear were investigated as function of time.

Figure 12:
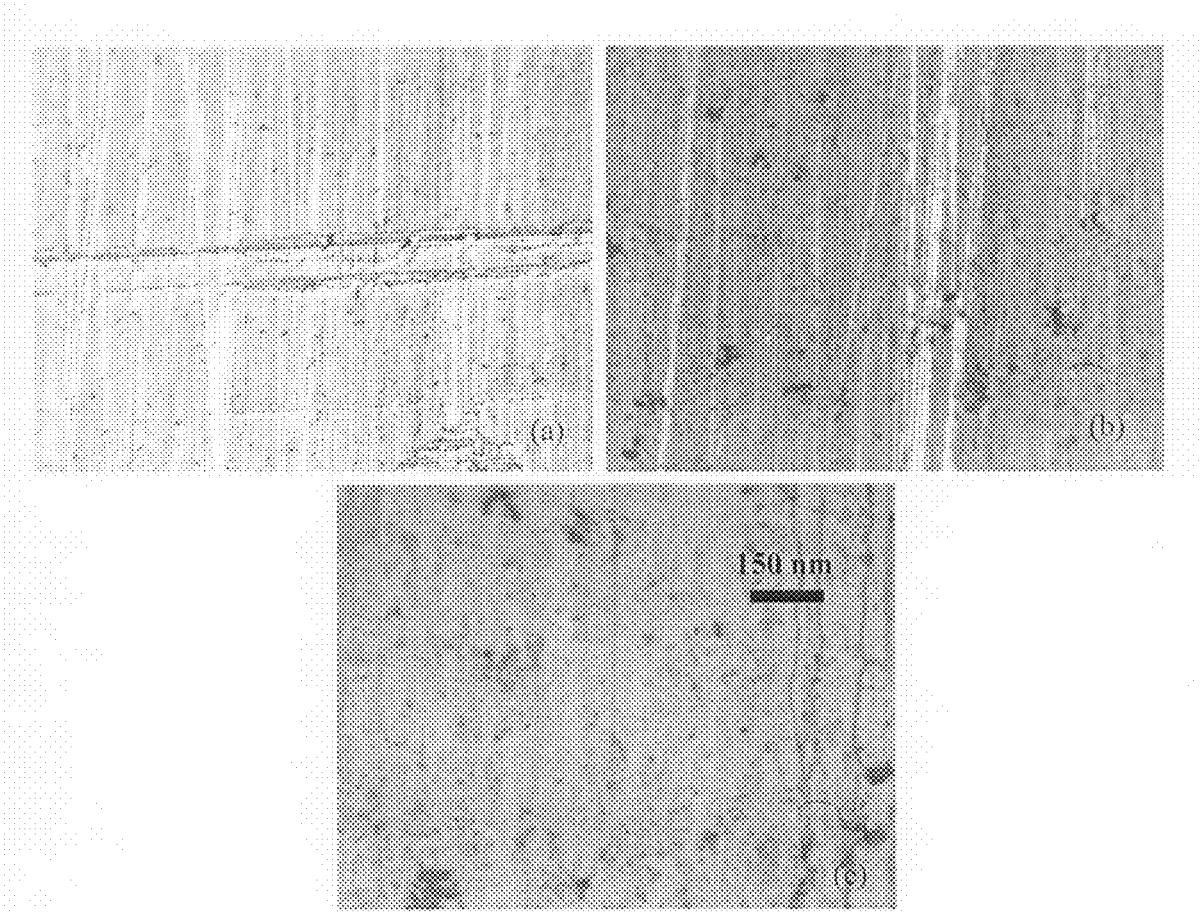
FIGS. 12 (*a*)-(*c*) show photomicrographs wherein FIG. 12(*a*) shows a metal surface at low magnification after surface treatment/polishing by graphite microparticles and filling in of surface grooves.

FIG. 12 (*a*) shows surface smoothening and polishing effect as a result of treatment with graphite oil treatment of an aluminum alloy. FIG. 12 (*b*) shows a significant coverage with the graphite layer at a low magnification. This can fill in surface roughness on metallic surfaces. As the treatment time increases, further polishing of the surface occurs and embedding of nanoparticles of graphite is clearly shown in FIG. 12(*c*). There are also some graphite microparticles present on the surface. Thus, graphite oil treatment results in polishing (smoothening) of interior metallic surfaces of engines to reduce friction, and embedding of nanoparticles workhardens the surface to reduce friction as well as wear. These micrographs also show embedding of graphite nanoparticles which workharden the surface to reduce wear as well as friction.

Figure 13:
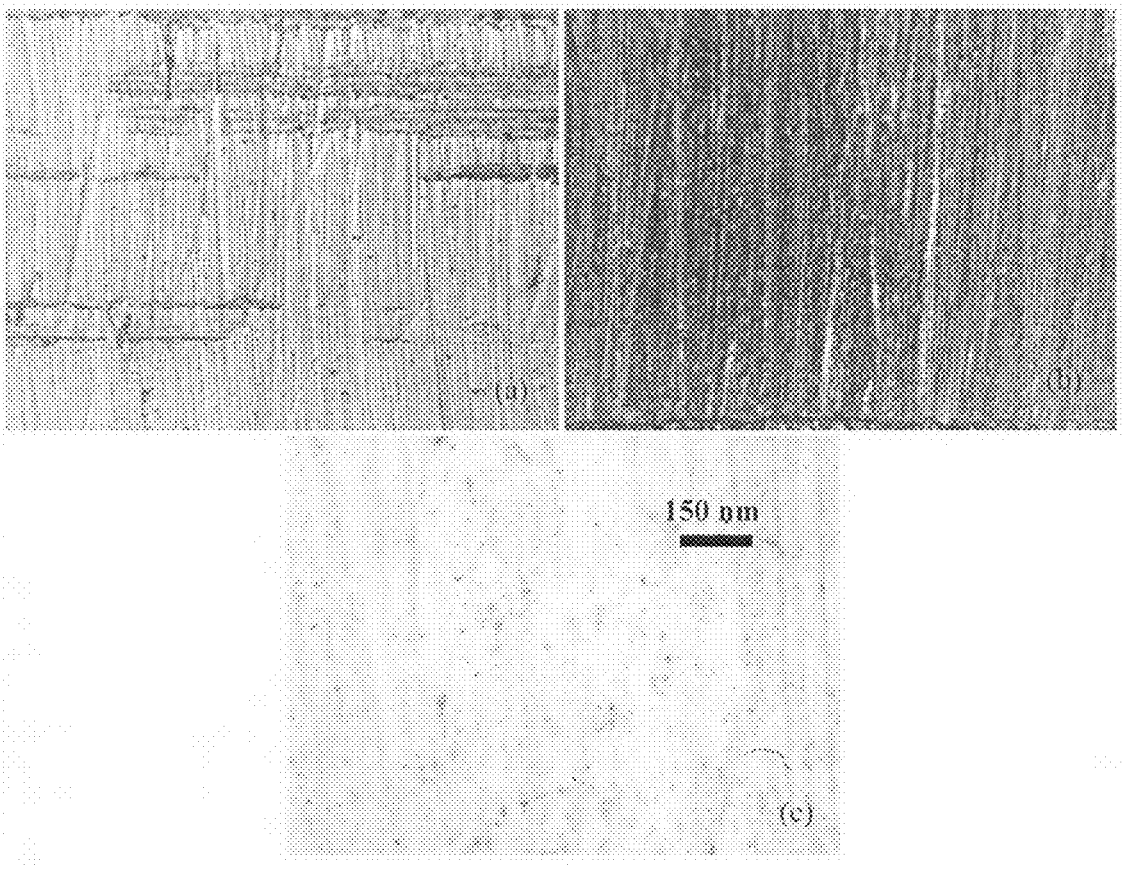
FIGS. 13 (*a*)-(*c*) are photomicrographs wherein FIG. 13(*a*) shows a metal surface at low magnification after surface treatment/polishing of an aluminum alloy by nano alumina and micro graphite and filling in of surface grooves.

FIG. 13 (*a*) shows results from a combination of nano alumina and micrographite, where the polishing effect and removal of scratches are clearly demonstrated. The combined alumina and graphite treatment is quite effective in reducing friction and creating workhardening to reduce friction and wear considerably. FIG. 13(*b*) shows complete coverage with the graphite layer at a low magnification, this action being effective to fill in the grooves and smoothen out the rough surfaces of the engine quite effectively. FIG. 13(*c*) demonstrates further polishing and shows that nanoparticles of alumina and graphite are embedded into the near surface regions, which can lead to hardening of the surface. There are also a few graphite microparticles present on the surface. Some of the graphite microparticles seem to have been ground to nano size range during the rubbing of metallic parts.

Figure 14:
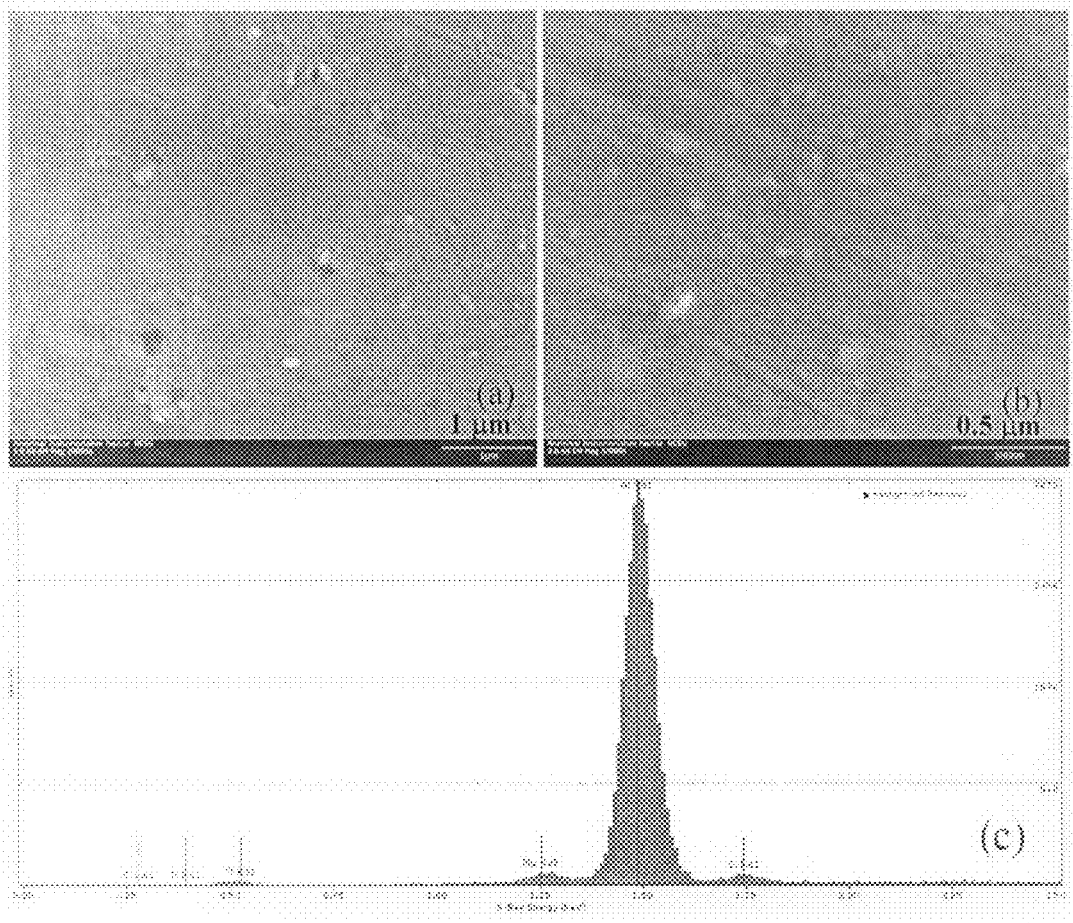
FIGS. 14 (*a*)-(*b*) are scanning electron micrographs showing polishing of an aluminum alloy and embedding by nano alumina and micro graphite.

The SEM (scanning electron microscopy) results from this sample are shown in FIG. 14. The SEM micrographs in FIGS. 14(*a*) and 14(*b*) clearly show the embedding of alumina and graphite nanoparticles into a very smooth metallic surface of the aluminum alloy. A small fraction of micro graphite has a size distribution in the nano-range. Thus, alumina and graphite nano and microparticle treatment seems to be more effective in reducing friction and wear of interior parts of the engine.

Figure 15:
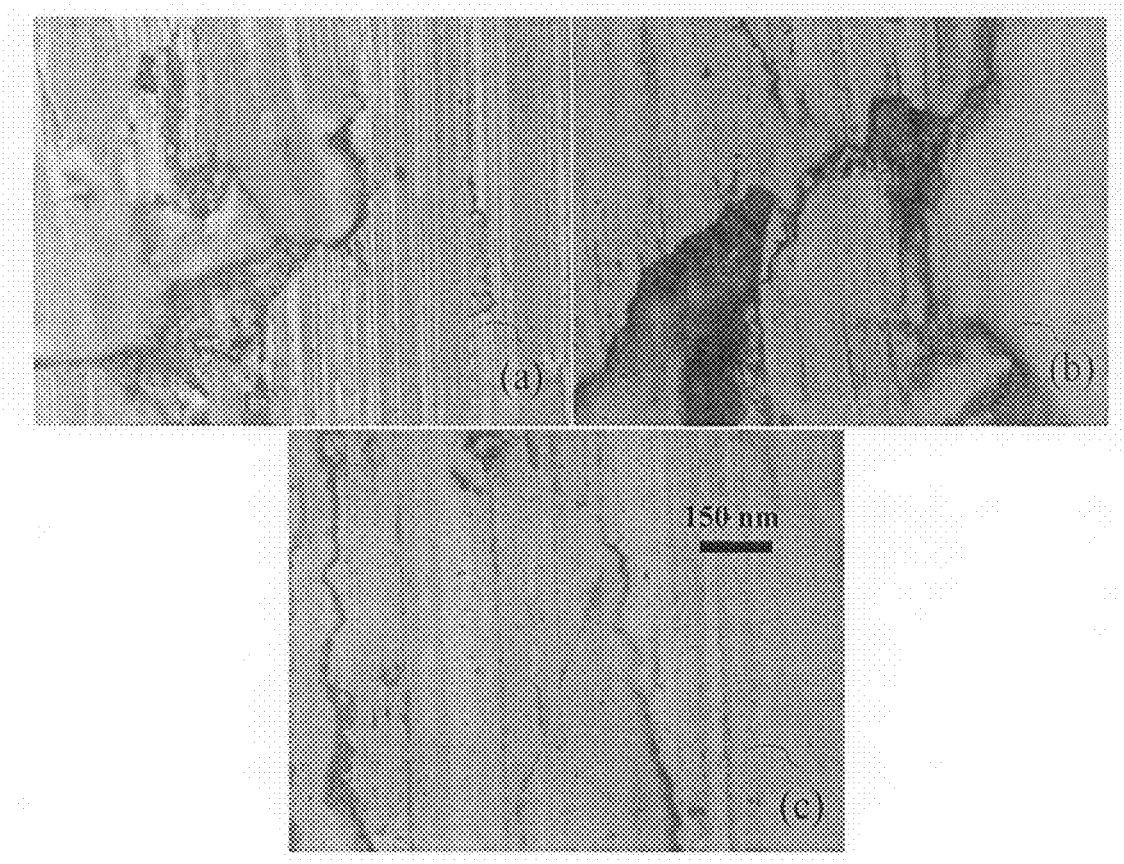
FIGS. 15 (*a*)-(*c*) are photomicrographs wherein FIG. 15(*a*) shows a cast iron metal surface at low magnification after surface treatment/polishing by nano alumina and micro graphite and filling in of surface grooves.

The results from the treatment of cast iron engine alloy by alumina nano and graphite microparticles are shown in FIG. 15. FIG. 15(*a*) shows polishing of a rough cast iron surface and filling in of pits on the surface with graphite. Upon increasing the time of treatment, polishing and repair of surface roughness continues (FIG. 15(*b*)). After 10 minutes of treatment, there is a polished surface and there is embedding of graphite and alumina nanoparticles into the cast iron in the near surface regions to improve friction and reduce wear via near surface workhardening (FIG. 15(*c*)).

Figure 16:
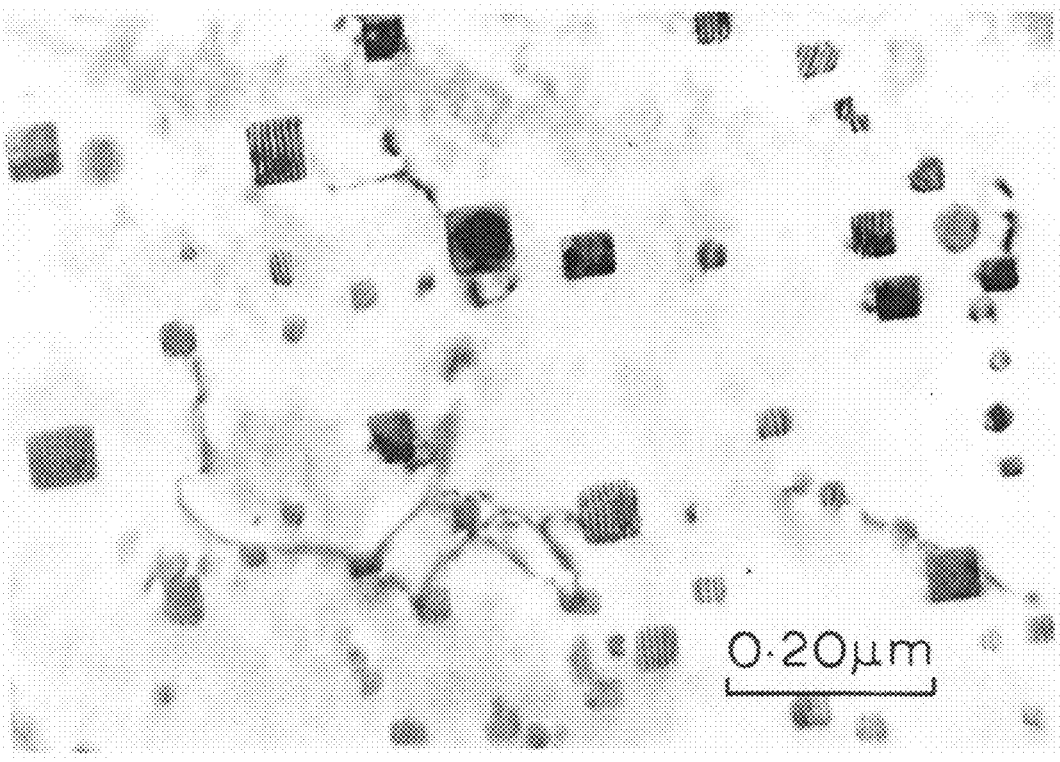
FIG. 16 is a transmission electron micrograph showing Ni nanoparticles embedded into an MgO matrix to improve mechanical properties.

FIG. 16 shows an electron micrograph of embedded nickel nanoparticles into MgO ceramic. This treatment has been shown to improve mechanical properties (hardness and wear) of the near-surface regions. The embedding of nanoparticles can create plastic damage and hinder the dislocation motion. Both of these mechanisms workharden the surface and reduce friction and wear. In summary, nanoparticles and microparticles lead to reduction in friction and wear via polishing of rough surfaces, filling in pits and grooves, embedding of nanoparticles, smoothening of surfaces and interface layering.

Specific formulations were prepared based upon h-BN and graphite microparticles (size range 0.5-15 μm), and silica, alumina and zinc oxide nanoparticles (20-40 nm). Nanoparticles of alumina and silica, and microparticles of graphite and h-BN were each dispersed into mineral oil or the engine oil having low viscosity (preferably 0W20, 5W20, 5W30) with concentration ranging 1.0 to 10.0 wt. % with an overall concentration (per five US quarts of oil) of 0.03%, 0.05%, 0.07%, 0.09%, 0.11%, 0.13% and 0.15% for h-BN or graphite microparticles with silica, alumina or zinc oxide nanoparticles.

The following formulations are for 5 quarts of engine oil: (1) Formulation NP 1040: 50 mL of engine oil with 1.5%, 2.5%, 3.5%, 4.5%, 5.5%, 6.5%, and 7.5% wt. % nano silica and 50 mL of engine oil with 1.5%, 2.5%, 3.5%, 4.5%, 5.5%, 6.5%, and 7.5% wt. % micro graphite. (2) Formulation NP 2030: 50 mL of nano alumina engine oil with 1.5%, 2.5%, 3.5%, 4.5%, 5.5%, 6.5%, and 7.5% wt. % and 50 mL engine oil with 1.5%, 2.5%, 3.5%, 4.5%, 5.5%, 6.5%, and 7.5% wt. % of h-BN. (3) Formulation NP 2020: 100 mL engine oil with 1.5%, 2.5%, 3.5%, 4.5%, 5.5%, 6.5%, and 7.5% wt. % nano alumina. (4) Formulation NP 1030: 50 mL engine oil with 1.5%, 2.5%, 3.5%, 4.5%, 5.5%, 6.5%, and 7.5% wt. % nano silica and 50 mL engine oil with 1.5%, 2.5%, 3.5%, 4.5%, 5.5%, 6.5%, and 7.5% wt. % of micro h-BN. (5) Formulation NP 2040: 50 mL engine oil with 1.5%, 2.5%, 3.5%, 4.5%, 5.5%, 6.5%, and 7.5% wt. % of nano alumina and 50 mL engine oil with 1.5%, 2.5%, 3.5%, 4.5%, 5.5%, 6.5%, and 7.5% wt. % of micro graphite. (6) Formulation NP 1010: 100 mL engine oil with 1.5%, 2.5%, 3.5%, 4.5%, 5.5%, 6.5%, and 7.5% wt. % nano silica. (7) Formulation NP 3030: 100 mL engine oil with 1.5%, 2.5%, 3.5%, 4.5%, 5.5%, 6.5%, and 7.5% wt. % nano h-BN and micro h-BN.

The following formulations are for 5 quarts of engine oil with ZnO nanoparticles: (8) N27 formulation: 50 mL engine oil with 1.5%, 2.5%, 3.5%, 4.5%, 5.5%, 6.5%, and 7.5% wt. % micro graphite solution and 50 mL engine oil with 1.5%, 2.5%, 3.5%, 4.5%, 5.5%, 6.5%, and 7.5% wt. % nano ZnO; (9) N27 plus formulation: 50 mL engine oil with 1.5%, 2.5%, 3.5%, 4.5%, 5.5%, 6.5%, and 7.5% wt. % micro h-BN and 50 mL engine oil with 1.5%, 2.5%, 3.5%, 4.5%, 5.5%, 6.5%, and 7.5% wt. % nano ZnO; (10) N02 formulation: 100 mL engine oil with 1.5%, 2.5%, 3.5%, 4.5%, 5.5%, 6.5%, and 7.5% wt. % nano of ZnO. These formulations are for engine oil that is free from ZDDP as ZnO may react with ZDDP and reduce its effectiveness.

The total nanoparticle and microparticle concentrations, in weight %, of specific formulations with equal amounts of nanoparticles and microparticles (in 100 ML of engine oil) can be 0.01 to 1%, 1 to 2%, 2 to 3%, 3 to 4%, 4 to 5%, 6 to 7% or higher. However, for newer engines the nanoparticle content exceeds the microparticle content and for older engines the microparticle content exceeds the nanoparticle content.

An engine oil additive can include a combination of nanoparticles (≦100 nm) of one or more materials and microparticles (≧100 nm) of one or more materials added together or separately to the engine oil. These nanoparticles can be in the form of nanorods, nanotubes, nanobelts, and buckyballs. The nanoparticles can be chosen from the group of relatively hard materials such as nanodiamond and related materials, boron, cubic boron nitride and related materials, alumina, silica, ceria, titania, molybdenum oxide, zinc oxide, magnesium oxide and zinc-magnesium oxide alloys. The microparticles can be chosen from layered materials such as graphite, hexagonal boron nitride, molybdenum disulphide, alumina, mica, talc etc. The relative fraction of nanoparticles to microparticles may vary from 10 to 80%, depending upon the characteristics of the engine materials. The nanoparticles can be produced by a laser synthesis method. By using this method, nanoparticles of desired chemical composition and narrow-size distribution can be formed and dispersed directly into a desired medium, thus solving a critical dispersion problem associated with nanoparticles. Microparticles can be added into the engine oil, in which nanoparticles are already dispersed, in a certain concentration and size range. These particles can also be dispersed in a base such as mineral oil, engine oil, synthetic oil such as polyolefin, and monomer polymers in a concentration, in weight %, of 1-10% with an overall final concentration of about 0.02 to 0.2% in the engine oil. To improve dispersion further certain surfactants may be added.

Formulations can include the following:

| Formulation | Nanoparticles | Microparticles |
|---|---|---|
| NP 1040 | 50 mL Silica | 50 mL graphite |
| NP 2030 | 50 mL alumina | 50 mL h-BN |
| NP 1030 | 50 mL silica | 50 mL h-BN |
| NP 2040 | 50 mL alumina | 50 mL graphite |

The specific nanoparticle plus microparticle concentrations in these formulations preferably are 1.5%, 2.5%, 3.5%, 4.5%, 5.5%, 6.5% and 7.5% with an overall concentration (per 5 US quartz of engine oil) of 0.03%, 0.05%, 0.07%, 0.09%, 0.11%, 0.13% and 0.15%.

As discussed above, the nanoparticles produce a fine polishing effect and embed into the near surface regions to reduce friction and wear. The microparticles produce a rough polishing effect and layer on the surface to reduce friction and wear.

Reduction in exhaust emissions of carbon dioxide and carbon monoxide up to 90% by volume can be achieved using the nano and microparticle treatments as described herein. The nano and microparticle treatments as described herein can reduce coefficient friction of aluminum alloys and cast iron from typical values of 0.22 to 0.01.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A lubricant comprising:

hard nanoparticles having a size and hardness effective for embedding the hard nanoparticles in and work harden metal surfaces lubricated by the lubricant; and soft microparticles having layered structures and a size and composition effective for filling voids in the lubricated surfaces;

wherein the hard nanoparticles and soft microparticles are dispersed in a hydrocarbon medium, the nanoparticles having an average particle size of about 20 to 40 nm are selected from alumina, silica, ceria, titania, diamond, cubic boron nitride, and molybdenum oxide and the microparticles are selected from graphite, hexagonal boron nitride, magnesium silicates (talc) and molybdenum disulphide.

2. The lubricant of claim 1, wherein the nanoparticles are alumina.

3. The lubricant of claim 1, wherein the microparticles are of graphite, hexagonal boron nitride, magnesium silicates (talc) and molybdenum disulphide having an average particle size of 1 to 20 μm.

4. The lubricant of claim 1, wherein the nanoparticles comprise 10 to 80% of total nanoparticle plus microparticle content.

5. The lubricant of claim 1, wherein the nanoparticles are produced by pulsed laser synthesis.

6. The lubricant of claim 1, wherein the lubricant is an engine oil additive and the nanoparticles and microparticles comprise up to 10% by weight of the engine oil additive.

7. Engine oil containing the engine oil additive of claim 6, wherein the nanoparticles and microparticles are present in an amount of up to 1% by weight in the engine oil.

8. The engine oil of claim 7, wherein the engine oil is a 0W20, 5W20, 5W30 or 10-30 weight engine oil.

9. A method of reducing friction of wear surfaces comprising lubricating wear surfaces with lubricant containing hard nanoparticles and soft microparticles having layered structures wherein the nanoparticles are effective to polish the wear surfaces with at least some of the nanoparticles becoming embedded in and work hardening the wear surfaces and the layered microparticles are effective to fill in voids in the wear surfaces wherein the hard nanoparticles and soft microparticles are dispersed in a hydrocarbon medium, the nanoparticles having an average particle size of about 20 to 40 nm are selected from alumina, silica, ceria, titania, diamond, cubic boron nitride, and molybdenum oxide and the microparticles are selected from graphite, hexagonal boron nitride, magnesium silicates (talc) and molybdenum disulphide.

10. The method of claim 9, wherein the lubricant is an engine oil and the coefficient of friction is reduced from a range of 0.2 to 0.4 to a range of 0.01 to 0.02 on cast iron and aluminum alloy wear surfaces.

11. The method of claim 10, wherein the engine oil reduces friction of the wear surfaces sufficiently to increase fuel efficiency by at least 10%.

12. The method of claim 10, wherein the engine oil reduces carbon dioxide emissions of the engine by at least 20%.

13. The method of claim 10, wherein the engine oil reduces emissions of carbon dioxide and carbon monoxide by at least 50% and up to 90% compared to the same engine oil without the engine oil additive.

14. A method of manufacturing the lubricant of claim 1, comprising dispersing the hard nanoparticles in the hydrocarbon medium by pulsed laser ablation of a target material and adding the soft layered microparticles to the hydrocarbon medium with 1.0 to 10.0 wt. % concentration.

15. The method of claim 14, further comprising adding the hydrocarbon medium to engine oil with 0.02 to 0.2 wt. % by weight total of the hard nanoparticles and soft layered microparticles in the engine oil.

* * * * *